US007377213B1

(12) United States Patent
Haberstroh et al.

(10) Patent No.: US 7,377,213 B1
(45) Date of Patent: May 27, 2008

(54) STRAPPING MACHINE WITH IMPROVED TENSION, SEAL AND FEED ARRANGEMENT

(75) Inventors: James A. Haberstroh, Vernon Hills, IL (US); Clayton W. Beilstein, Mt. Prospect, IL (US); Ronald Gurak, Oakwood Hills, IL (US); Timothy B. Pearson, Antioch, IL (US); Lemuel J. Bell, Jr., Gurnee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/852,016

(22) Filed: Sep. 7, 2007

(51) Int. Cl.
*B65B 13/22* (2006.01)
*B65B 13/32* (2006.01)

(52) U.S. Cl. ..... 100/29; 100/26; 100/32; 100/33 R; 53/589

(58) Field of Classification Search ..... 100/8, 100/26, 29, 30, 32, 33 R, 33 PB; 53/589; 140/93.2, 93.4, 123.5
See application file for complete search history.

(56) References Cited

U.S. PATENT DOCUMENTS 1,535,716 A * 4/1925 Cary ..... 100/30
1,555,819 A * 10/1925 Baruch ..... 254/234
4,018,146 A * 4/1977 Evans ..... 100/26
4,254,703 A * 3/1981 Fulton et al. ..... 100/2
4,605,456 A 8/1986 Annis, Jr.
6,367,376 B1 4/2002 Bobren
6,663,040 B2 12/2003 Haberstroh et al.
6,708,606 B1 3/2004 Bell et al.

* cited by examiner

*Primary Examiner*—Jimmy T Nguyen
(74) *Attorney, Agent, or Firm*—Mark W. Croll; Donald J. Breh; Levenfeld Pearlstein, LLC

(57) ABSTRACT

A floating strapping head is for use in a strapping machine of the type for positioning, tensioning and sealing a strapping material to itself around a load. The strapping machine has a frame and a strap chute. The floating strapping head includes a tensioning module, a separate sealing module and a drive assembly operably connected to the tensioning module and the sealing module. The head includes a guide along which the tensioning and sealing modules move laterally, together and toward and away from one another. When tension is drawn in the strapping material with an end of the strapping material gripped by the sealing head and an opposite portion of the strapping material gripped by the tensioning module, the drive is actuated to move the tensioning and sealing modules away from one another. The tensioning and sealing modules float, moving along the guide, as one, to equalize the tension in the strapping material on either side of the strapping head.

14 Claims, 7 Drawing Sheets

STRAPPING MACHINE WITH IMPROVED TENSION, SEAL AND FEED ARRANGEMENT

BACKGROUND OF THE INVENTION

This invention pertains to a strapping machine. More particularly, this invention pertains to an improved tension, seal and feed arrangement for a strapping machine for plastic strapping material.

Strapping machines are well-known in the art. There are two principle types of strapping machines, manual and automatic, table-top or free-standing machines. Strapping machines are typically designed for use with either plastic or metal (steel) strapping. These machines position, tension and seal strap around a load to bundle or secure the load.

A typical automatic strapping machine includes a frame-like support for the overall machine, a working area to, for example, support a load, a feed head to feed strap around the load and to retract strap prior to tensioning, a chute through which the strap is fed around the load, a strapping head to secure the strap to itself and one or more dispensers for dispensing the strap material to the strapping head.

In a plastic strapping machine, the strapping head serves a number of functions. First, it clamps or grips a free end of the strap as it returns to the strapping head, it clamps or grips a trailing end of the strap following retraction and during tensioning of the strap and it grips the strap again on the opposite or inside of the strap loop, as it severs the sealed strap from the feed or dispenser side and seals the overlapping courses of strapping together.

The feed head typically includes one or more pairs of rotating wheels to feed strap into the strapping head, around the strap chute and back to the strapping head. The feed head also includes a retraction arrangement to retract the slack strap and to "pull" the strap from the strap chute onto the load or package to be strapped. The feed head also includes a tension arrangement to pull tension in the strap to secure the load prior to forming a seal in the strap loop. Known strapping machine feed heads include two pairs of rotating wheels to carry out the feed, retraction and tension functions. Others include a single pair of wheels to carryout these functions. In each, typically, one of the wheels of each pair is a driven wheel and the other wheel is an idler wheel (to provide a surface against which the driven wheel rotates). Still other arrangements use a windlass or winder around which the strap is wound to pull tension in the strap. The winder can be located in the strapping head, in the feed head, or between the heads.

While these arrangements function well to tension the strap, they do so by pulling the strap from one end in an effort to tension the strap along the entire length of the strap as it is wrapped around the load. This typically results in an unequal tension being drawn in the strap. The tension is greatest in the (straight) section of strap from the tensioning device to the first corner of the load. The tension is next highest in the straight section of strap from the first corner to the next corner. In turn, the tension is reduced in each section of strap around the load until the leading end of the strap is reached.

To accommodate the unequal tensioning in the strap, one arrangement uses a strapping head (with tensioning device) that is allowed to "float" in the direction of strap feed (with a spring return) or is pushed mechanically (such as by a cylinder) in the float direction to try to equalize the tension in the strap all around the load.

Neither of these equalizing arrangements have been found to be fully effective because the external force is applied to the strap in only one direction. Moreover, both of these arrangements require additional parts and/or assemblies to float and return the sealing head from the float position.

Accordingly, there is a need for a strap tension equalizing assembly that equalizes the tension in the strap on both sides of and in both directions from the strapping head. Desirably, such a device applies an approximately equal force in both directions on the strap. More desirably, such a device applies a force in both directions without the need for cylinders or springs to balance the device.

BRIEF SUMMARY OF THE INVENTION

A floating strapping head is used in a strapping machine of the type for positioning, tensioning and sealing a strapping material to itself around a load. The strapping machine has a frame and a strap chute. The floating strapping head includes a tensioning module and a separate sealing module.

A drive assembly is operably connected to the tensioning module and the sealing module and is configured to move the tensioning and sealing modules toward and away from one another while allowing the tensioning and sealing modules to float together, as one unit.

The strapping head includes a guide along which the tensioning and sealing modules move laterally (float), together and move toward and away from one another. Tension is drawn in the strapping material with an end of the strapping material gripped by the sealing head and an opposite portion of the strapping material gripped by the tensioning module, by actuating the drive to move the tensioning and sealing modules away from one another. The tensioning and sealing modules also float or move along the guide, as one, to equalize the tension in the strapping material on either side of the strapping head.

In a present strapping head the guide includes a rail, a carriage associated with the tensioning module and a carriage associated with the sealing module. The carriages ride along the rail.

The drive assembly includes a motor operably connected to a drive gear and a rack gear. The drive and rack gears mesh with one another to move the tensioning and sealing heads toward and away from one another.

In a present strapping head, movement of the tensioning module and sealing module away from one another actuates a tension gripper on the tensioning module. Engagement of the tensioning and sealing modules with one another releases the tension gripper.

A present strapping head can include a strap guide for feeding strapping material into the tensioning module.

A strapping machine includes a floating strapping head. Such a machine can be configured with the strap guide extending between the feed head and the strapping head, such that the feed head is mounted to the strap supply and the feed head and strap supply are located remotely of the floating strapping head.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
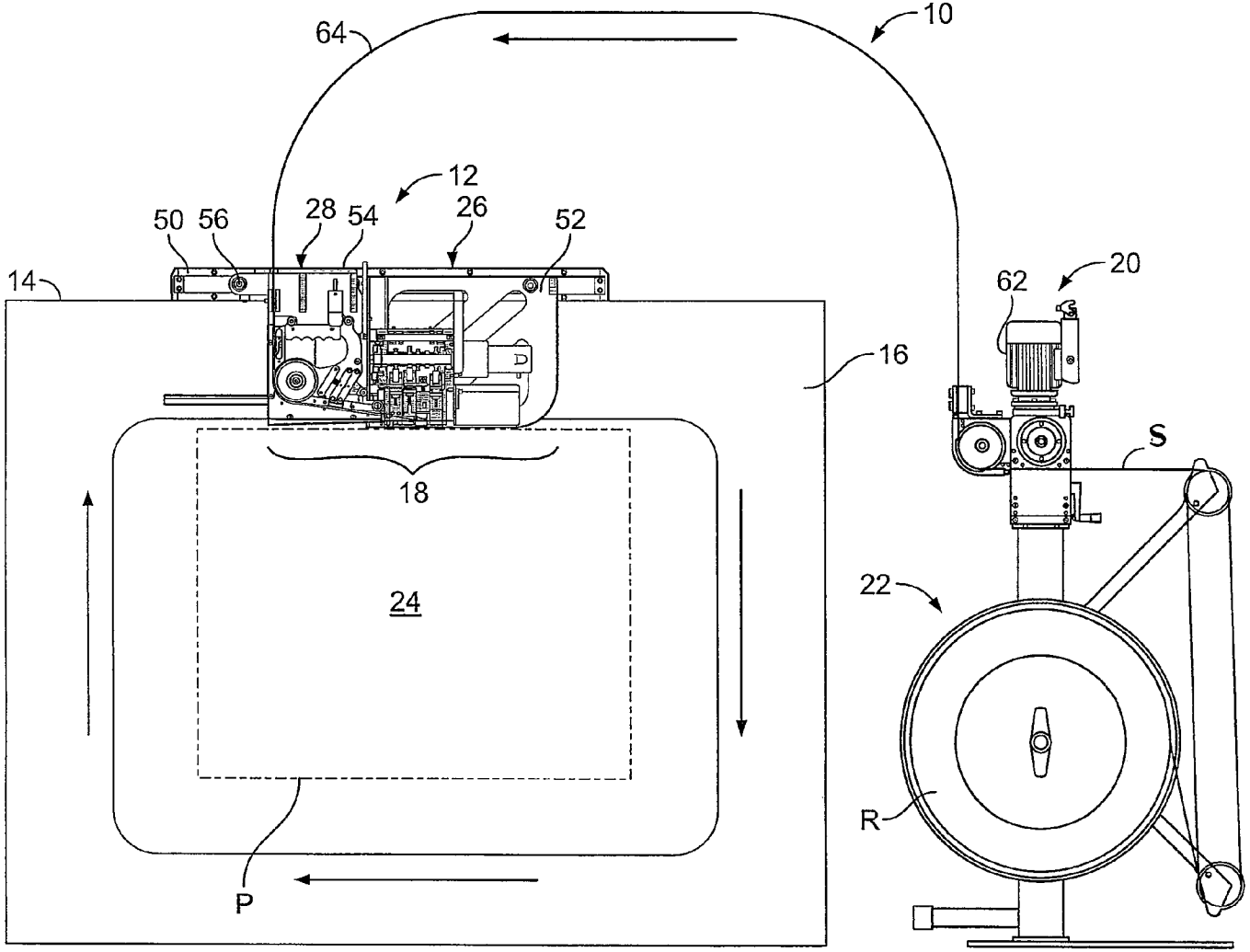
FIG. 1 is a front view of a strapping machine with improved tension and feed arrangement having a floating strapping head, embodying the principles of the present invention, the machine being shown in the home position or feed mode.
Figure 2:
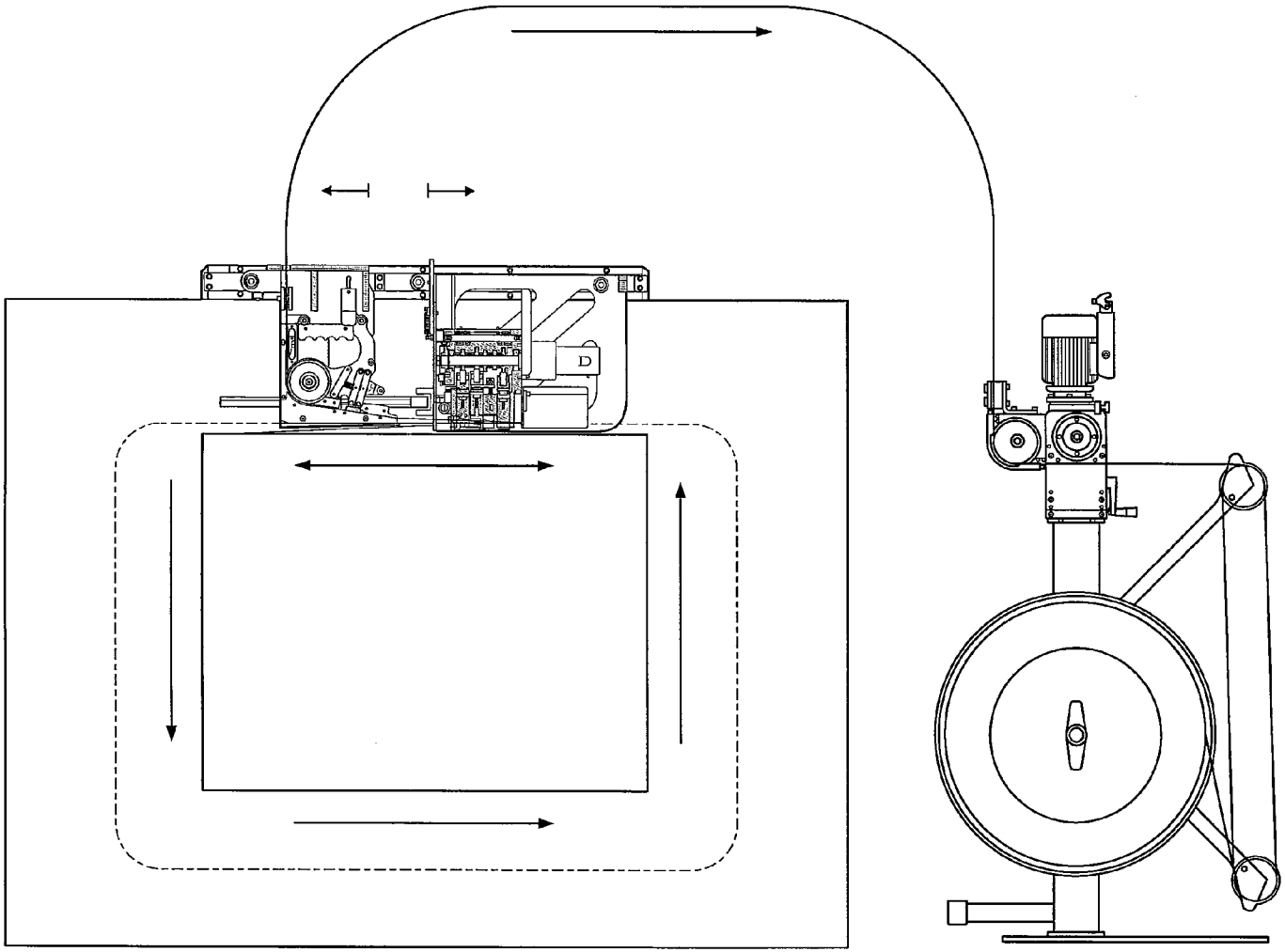
FIG. 2 is a front view of the strapping machine shown in the tensioning mode.
Figure 3:
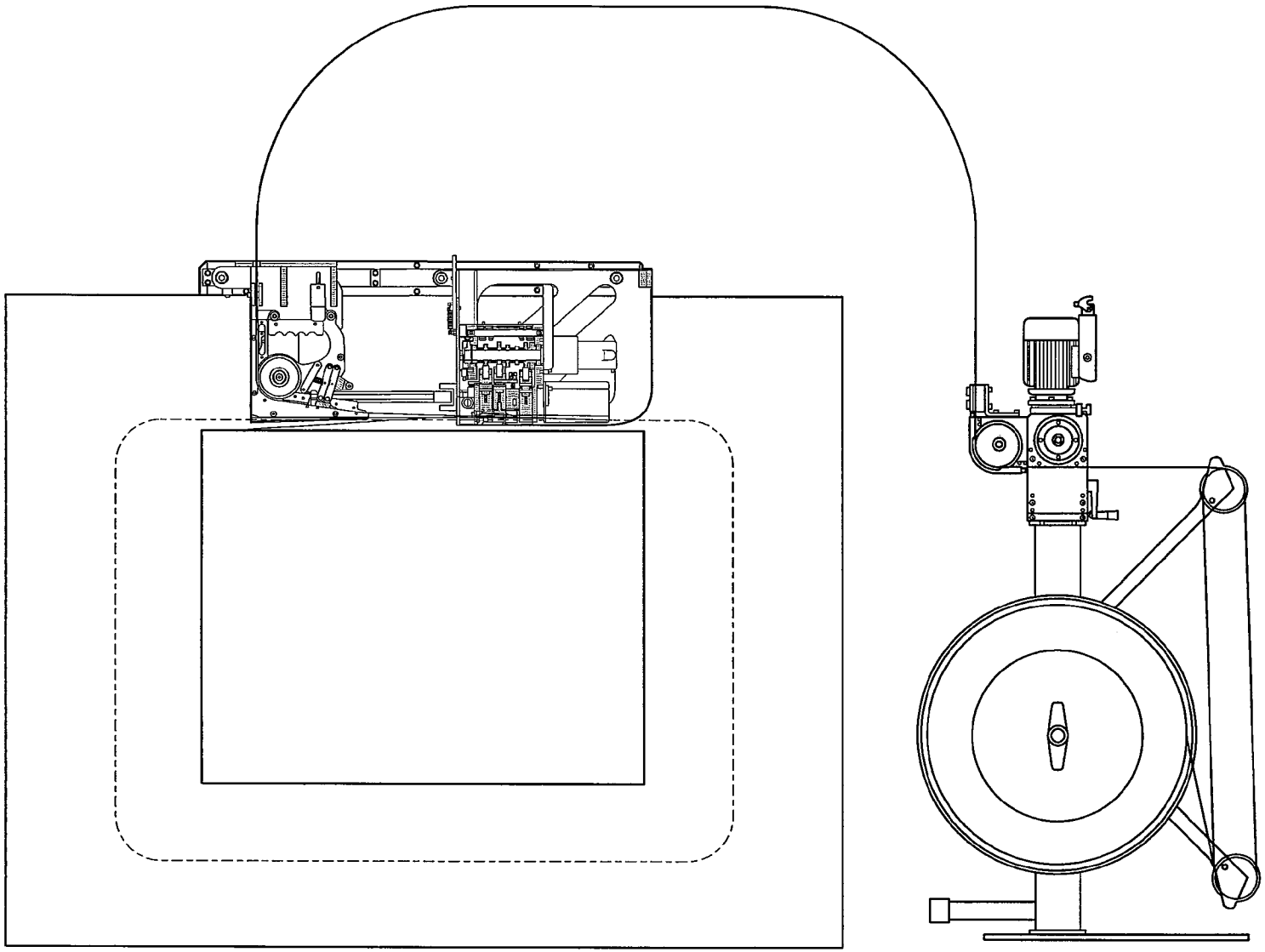
FIG. 3 is a front view of the strapping machine shown at tension (tension complete)

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1 there is illustrated a strapping machine 10 having an improved tension and feed assembly 12 embodying the principles of the present invention. The strapper 10 includes, generally, a frame 14, a strap chute 16, a strapping head 18, a feed or drive head 20 and a strap dispenser 22. As illustrated, the dispenser 22 and feed head 20 can be separately, remotely located (generally nearby), to facilitate maintenance of the dispenser 22 (e.g., reloading strap reels R) and the feed head 20 as needed. Advantageously, this can allow placing the feed head 20 at about ground or floor elevation. Packages P to be strapped are positioned within the chute area 24. Packages P can be of any size that fits within the chute 16 and chute area 24.

The strapping head 18 serves a number of functions, including directing the strap S into and out of the strap chute 16, gripping the strap S at various times and locations to tension the strap S, forming a seal (such as by welding) in the strap S and severing the looped (and to be sealed) strap S from the strap source or dispenser 22. The strapping head 18 may also serve to provide a tension in the strap S through use of a tensioning assembly or device.

The present strapping head 18 provides such a tensioning function by use of separate sealing and tensioning modules 26, 28. In such an arrangement, the sealing module 26 functions to provide the end grip, the loop grip, the strap seal or weld and strap cutting (to sever the loop from the strap source). The tensioning module 28 functions to provide the tension grip and to "pull" or exert a tension in the strap prior to forming the strap seal.

Accordingly, the sealing module 26 includes an end grip 30, a loop grip 32, a sealing element 34 such as a vibrating weld pad, and a cutter 36. The tensioning module 28 includes a tension grip 38, such as the illustrated self-energizing gripper to secure the strap S as tension is drawn in the strap S prior to forming the strap seal.

Unlike known strapping machines that use a single head that includes the strapping and tensioning functions, the present strapping head 18 uses sealing and tensioning modules 26, 28 that are separate from one another but are operably connected to one another by a drive assembly 40. The present drive assembly 40 is a rack (linear) gear drive arrangement. A motor 42 and drive gear 44 are mounted to the tensioning module 28. The drive gear 44 is meshed with a rack gear 46 which is mounted to the sealing module 26. This configuration permits the motor 42 to drive the drive gear 44 which in turn drives the tensioning module 28 and sealing module 26 away from and toward one another.

To effect smooth, linear movement of the modules 26, 28 toward and away from one another, and to allow the modules 26, 28 to move together (linearly) as one unit, or float, the modules 26, 28 are mounted to a linear guide 48. A present linear guide 48 includes a rail 50 and a roller carriage 52, 54 associated with each the sealing 26 and tensioning 28 modules. The carriages 52, 54 include rollers 56 to permit low friction movement (sliding) of the carriages 52, 54 along the rail 50. In this manner, as the tensioning motor 42 is actuated, the gears 44, 46 mesh to advance the drive gear 44 along the rack gear 46 which in turn moves the modules 26, 28 away from one another along the rail 50. The carriages 52, 54 (and thus the sealing 26 and tensioning 28 modules) can move toward and away from each other. And, because both of the carriages 52, 54 are mounted to the rail 50 on rollers 56, the carriages 52, 54 (and thus the modules 26, 28) move or float as one unit along the rail 50 during the tensioning cycle.

Figure 4:
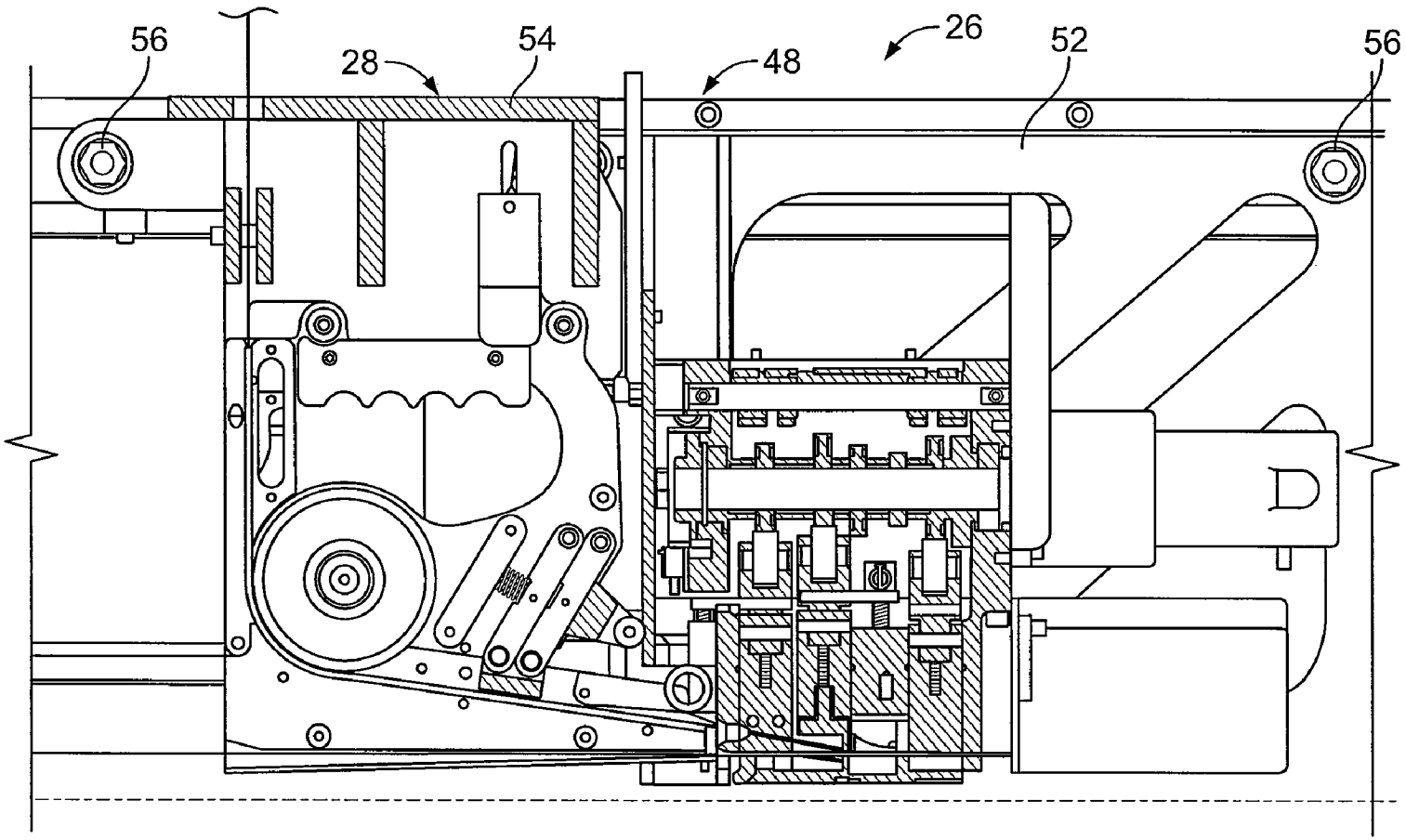
FIG. 4 is an enlarged front view of the strapping head in the feed mode of FIG. 1.
Figure 5:
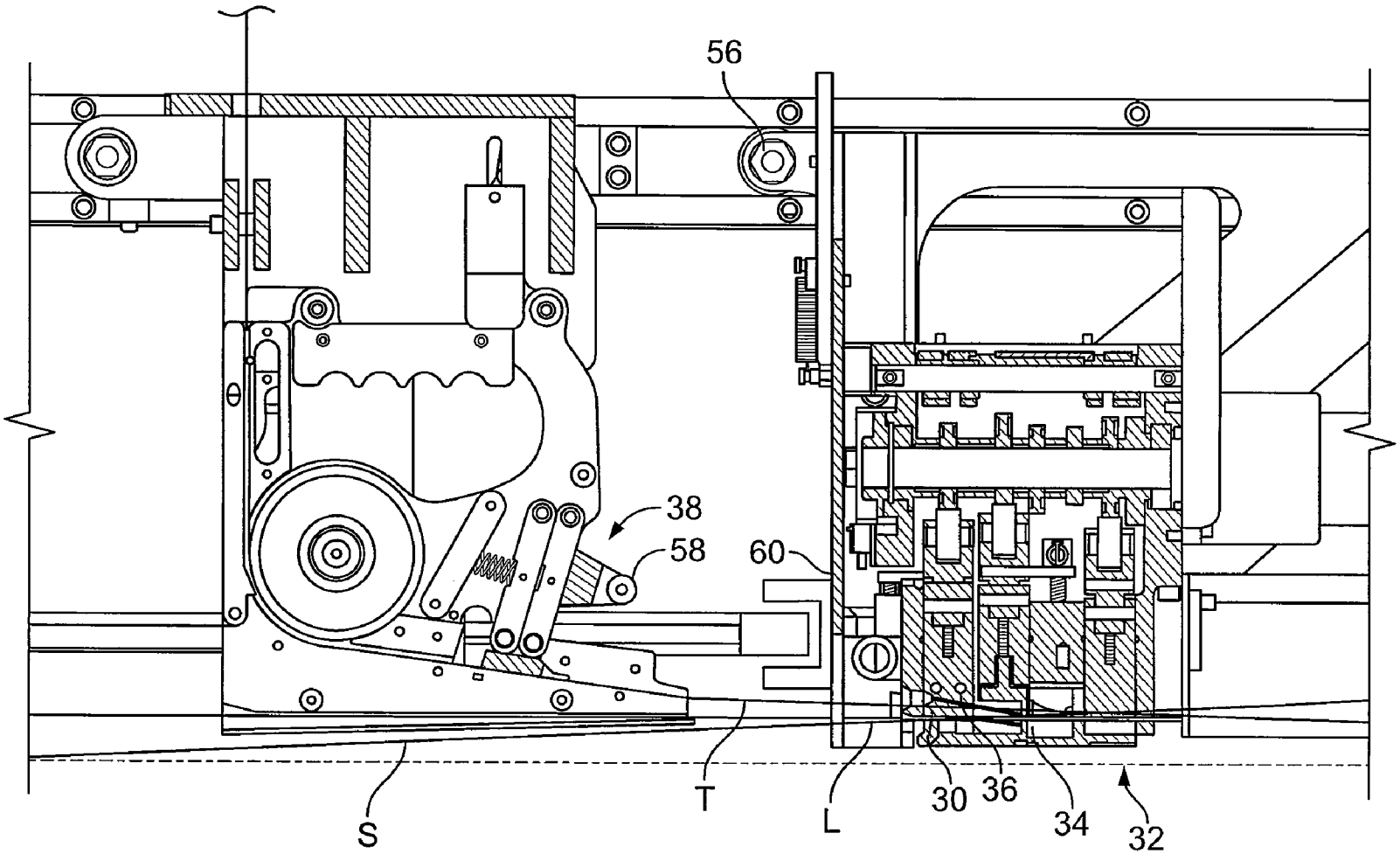
FIG. 5 is an enlarged front view of the strapping head in the tensioning mode of FIG. 2.

At the start of the strapping cycle (FIGS. 1 and 4), the tensioning 28 and sealing 26 modules are in the home position, abutted to one another. A tension gripper release cam 58 is engaged with a surface 60 of the sealing module 26 to maintain the tension gripper 38 in the open state.

With the load P positioned in the strapping machine 10, the feed head motor 62 is actuated. Strap S is pulled from the dispenser 22 and is fed through the strap guide 64 into and through the tensioning module 28 (with the tension gripper 38 open), and the sealing module 26 (with the end gripper 30 and loop gripper 32 open) and into and around the strap chute 16.

When the lead end L of the strapping material S is sensed upon return to the strapping head 18, the end gripper 30 closes and grips or clamps the lead end L of the strapping material S. The feed head motor 62 reverses and the (slack) strap S is retracted and then pulled from the strap chute 16 onto the load P.

Figure 6:
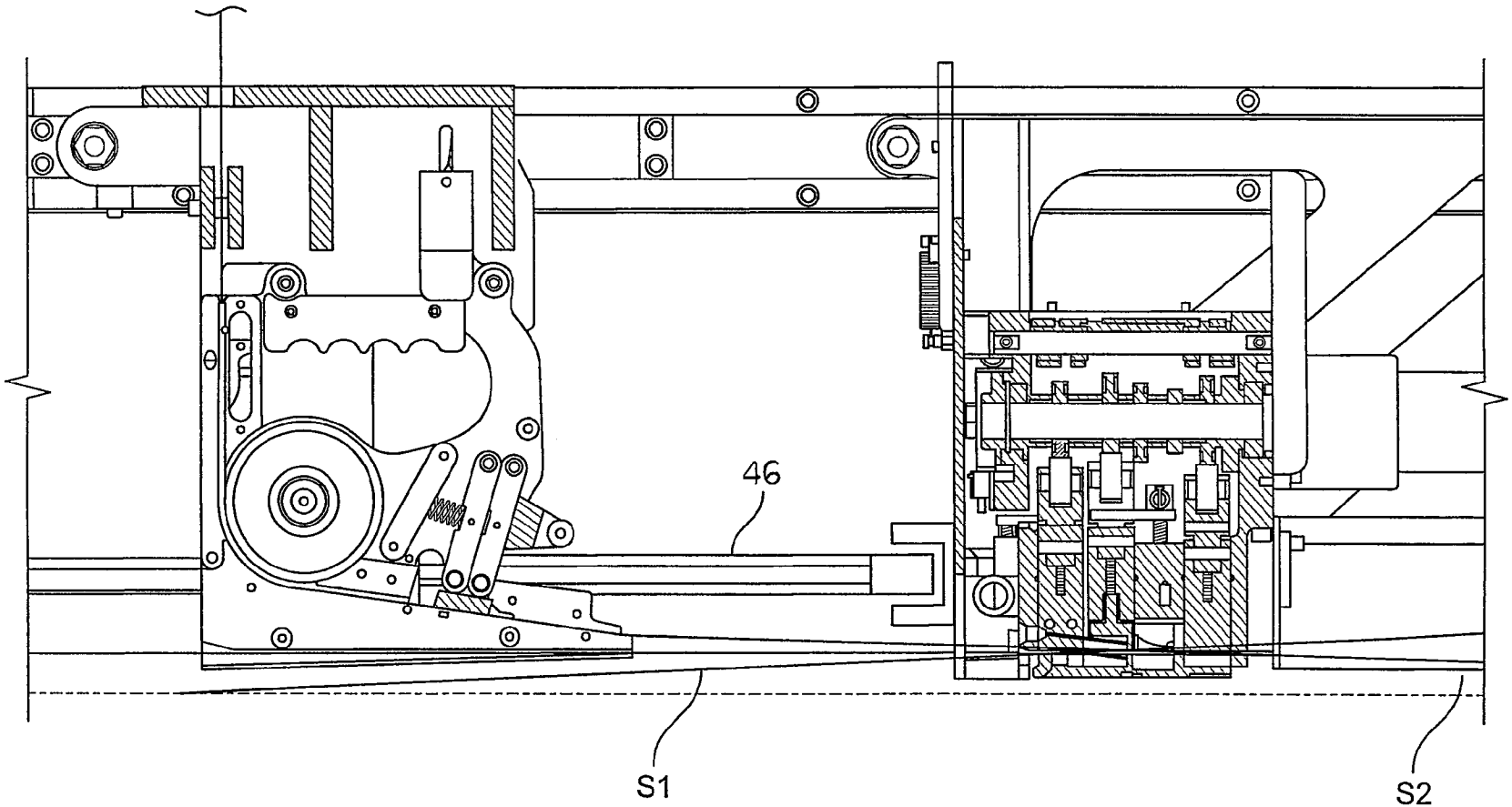
FIG. 6 is an enlarged front view of the strapping head at tension (tension complete) of FIG. 3.
Figure 7:
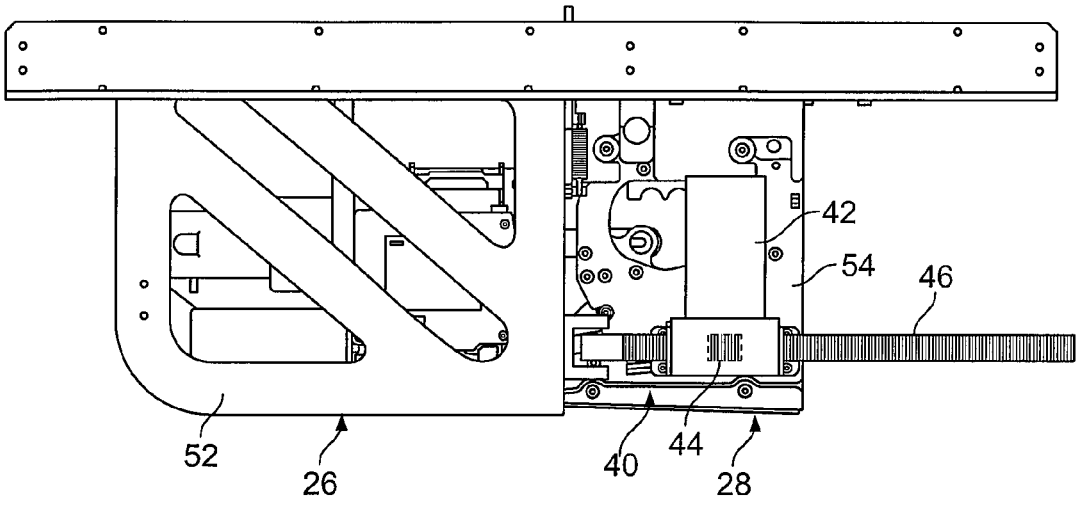
FIG. 7 is a rear view of the strapping head in the feed mode of FIGS. 1 and 4.
Figure 8:
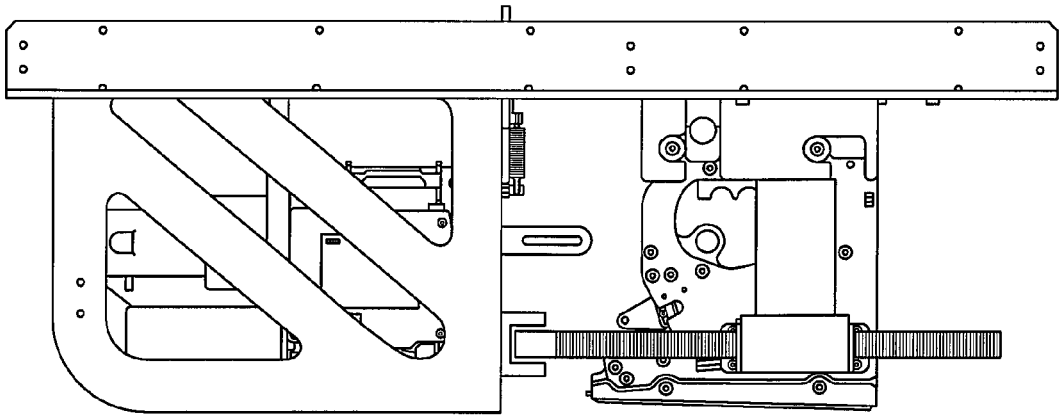
FIG. 8 is a rear view of the strapping head at tension (tension complete) of FIGS. 3 and 6.

Once retraction is complete, the tensioning module drive motor 42 actuates to move the tensioning 28 and sealing 26 modules away from each other. This releases the tensioning gripper release cam 58 so that the tension gripper 38 contacts and secures the strap S in the module 28. As the motor 42 continues to run, the sealing module 26 and tensioning module 28 are driven away from one another and the strap S is tensioned. As will be appreciated, the modules are operably connected to one another by the drive assembly 40 (the driven and rack gears 44, 46 and motor 42), but the modules 26, 28 float as one unit, as mounted to the machine 10 by the carriages 52, 54 (on the rail 50). As such, as tension is being drawn, the modules 26, 28 will float, e.g., move along the rail 50, together, to equalize the tension in the strap S on both sides (as indicated at $S_1$ and $S_2$ in FIG. 6) of the sealing module 26/tensioning module 28 (the strapping head 18), as the meshed drive and rack gears 44, 46 maintain the tension in the strap S.

When the desired tension has been achieved, the loop gripper 32 is engaged to clamp the "loop" of strapping material S closed; that is, the overlying courses of strapping material S are held secure. Once the loop gripper 32 is engaged, the rack is relaxed (the drive gear 44 is allowed to freely rotate) and the trailing end T of the strapping material S (the end toward the tensioning module 28) is severed to sever the loop from the material source, as the overlying courses of material are welded to one another by, for example, a vibrating weld element 34. The sealing module 26 is then opened to allow the strap S to exit the head 18, and the strapped load P is removed from the chute area 24.

The tensioning drive motor 42 is then operated in reverse to draw the modules 26, 28 together, which opens the tension gripper 38 (by contact of the gripper release cam 58 with the sealing module 60). The modules 26, 28, now in the home position, are ready to begin the next strapping cycle.

In order to control the tension in the strap S, a brushless DC motor with torque feed back is used as the drive assembly motor 42, to determine the applied tension. Advantageously, in this type of motor, the motor torque is independent of the electrical (power) variations and is directly proportional to the tension in the strap. The torque feedback thus allows for more accurate and consistent tension in the strap. This, in combination with the linear tension drive assembly 40, applies a true, consistent and linear force to the strap, reducing strap deformation and providing greater control and increased accuracy of the tension applied to the strap.

All patents referred to herein, are incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A floating strapping head for a strapping machine of the type for positioning, tensioning and sealing a strapping material to itself around a load, the strapping machine comprises a frame with a strap chute, the floating strapping head mounted within the frame, and the floating strapping head comprising:

a tensioning module;

a sealing module for welding overlying courses of the strapping material to one another;

a drive assembly operably connected to the tensioning module and the sealing module and configured to move the tensioning and sealing modules toward and away from one another; and a guide along which the tensioning and sealing modules move laterally, together and toward and away from one another, wherein when tension is drawn in the strapping material with an end of the strapping material gripped by the sealing head and an opposite portion of the strapping material gripped by the tensioning module, and the drive assembly is actuated to move the tensioning and sealing modules away from one another, the tensioning and sealing modules move along the guide, as one, to equalize the tension in the strapping material on either side of the strapping head.

2. The floating strapping head in accordance with claim 1 wherein the guide includes a rail, a carriage associated with the tensioning module and a carriage associated with the sealing module.

3. The floating strapping head in accordance with claim 1 wherein the drive assembly includes a motor operably connected to a drive gear and a rack gear, the drive and rack gears meshed with one another to move the tensioning and sealing heads toward and away from one another.

4. The floating strapping head in accordance with claim 1 wherein movement of the tensioning module and sealing module away from one another actuates a tension gripper on the tensioning module and engagement of the tensioning and sealing modules with one another releases the tension gripper.

5. The floating strapping head in accordance with claim 1 including a strap guide for feeding strapping material into the tensioning module.

6. The floating strapping head in accordance with claim 1 wherein the drive assembly includes a motor.

7. The floating strapping head in accordance with claim 6 wherein the motor is a brushless DC motor.

8. A strapping machine of the type for positioning, tensioning and sealing a strapping material to itself around a load, comprising:

a frame;

a strap chute mounted to the frame;

a feed head;

a strap supply; and a floating strapping head mounted within the frame and including a tensioning module, a sealing module for welding overlying courses of the strapping material to one another, a drive assembly operably connected to the tensioning module and the sealing module and configured to move the tensioning and sealing modules toward and away from one another, and a guide along which the tensioning and sealing modules move laterally, together, and toward and away from one another, wherein when tension is drawn in the strapping material with an end of the strapping material gripped by the sealing head and an opposite portion of the strapping material gripped by the tensioning module, and the drive assembly is actuated to move the tensioning and sealing modules away from one another, the tensioning and sealing modules move along the guide, as one, to equalize the tension in the strapping material on either side of the strapping head.

9. The strapping machine in accordance with claim 8 including a strap guide extending between the feed head and the strapping head, wherein the feed head is mounted to the strap supply and the feed head and strap supply are located remotely of the floating strapping head.

10. The strapping machine in accordance with claim 9 wherein the guide is mounted to the frame and includes a rail, a carriage associated with the tensioning module and a carriage associated with the sealing module, the carriages riding on the rail.

11. The strapping machine in accordance with claim 8 wherein the drive assembly includes a motor operably connected to a drive gear and a rack gear, the drive and rack gears meshed with one another to move the tensioning and sealing heads toward and away from one another.

12. The strapping machine in accordance with claim 8 wherein movement of the tensioning module and sealing module away from one another actuates a tension gripper on the tensioning module and engagement of the tensioning and sealing modules with one another releases the tension gripper.

13. The strapping machine in accordance with claim 8 wherein the drive assembly includes a motor.

14. The strapping machine in accordance with claim 13 wherein the motor is a brushless DC motor.

* * * * *